United States Patent [19]

Jeschke

[11] Patent Number: 4,896,601

[45] Date of Patent: Jan. 30, 1990

[54] INKING UNIT FOR ROTARY PRINTING PRESSES

[75] Inventor: Willi Jeschke, Bad Herrenalb, Fed. Rep. of Germany

[73] Assignee: Heidelberger Druckmaschinen Aktiengesellschaft, Heidelberg, Fed. Rep. of Germany

[21] Appl. No.: 272,534

[22] Filed: Nov. 16, 1988

[30] Foreign Application Priority Data

Nov. 25, 1987 [DE] Fed. Rep. of Germany ..... 3739893

[51] Int. Cl.[4] ..... B41F 31/10; B41L 27/08

[52] U.S. Cl. ..... 101/350

[58] Field of Search ..... 101/350, 363, 349, 348, 101/148, DIG. 32, 207-210

[56] References Cited

U.S. PATENT DOCUMENTS

| | | | |
|---|---|---|---|
| 1,292,244 | 1/1919 | Brown | 101/348 |
| 1,555,389 | 9/1925 | Stevens | 101/348 X |
| 1,717,737 | 6/1929 | Schlesinger | 101/350 |
| 2,054,763 | 9/1936 | Wulf | 101/219 |
| 2,354,981 | 8/1944 | Barber | 101/350 |
| 2,369,814 | 2/1945 | Worthington | 101/350 |
| 3,037,449 | 6/1962 | Aller | 101/350 |
| 3,417,692 | 12/1968 | Brodae | 101/350 |
| 3,538,849 | 11/1970 | Bohman | 101/352 |
| 3,651,758 | 3/1972 | Harrod | 101/350 |
| 4,402,263 | 9/1983 | Honkawa | 101/350 |
| 4,440,081 | 4/1984 | Beisel | 101/148 |
| 4,449,451 | 5/1984 | Junghans | 101/350 |
| 4,632,029 | 12/1986 | Simeth | 101/348 |
| 4,660,470 | 4/1987 | Kramp et al. | 101/426 |

FOREIGN PATENT DOCUMENTS

| | | | |
|---|---|---|---|
| 2303132 | 1/1973 | Fed. Rep. of Germany . | |
| 833323 | 10/1938 | France | 101/350 |

*Primary Examiner*—J. Reed Fisher

*Attorney, Agent, or Firm*—Nils H. Ljungman

[57] ABSTRACT

An inking unit is for a rotary printing press having ink rollers for providing ink to a printing plate of a plate cylinder. The inking unit includes an ink fountain and an ink fountain roller for receiving a supply of the ink thereon from the ink fountain. A first distributor roller transfers ink thereon to the ink rollers. A transfer roller is disposed between the ink fountain roller and the first distributor roller for transferring at least some of the ink on the ink fountain roller to the first distributor roller. The transfer roller is generally cylindrical and includes a surface which has a circumference which alternately includes raised areas and recessed areas. The transfer roller is in contact with the ink fountain roller at at least one of the raised areas to receive some of the ink therefrom when at least one of the recessed areas is adjacent the first distributor roller to prevent contact therebeween. Additionally, the transfer roller is in contact with the first distributor roller at at least one of the raised areas to supply some of the ink thereto when at least one of the recessed areas is adjacent the ink fountain roller to prevent contact therebetween.

17 Claims, 1 Drawing Sheet

SPEED CONTROL

INKING UNIT FOR ROTARY PRINTING PRESSES

BACKGROUND OF THE INVENTION

1. Field of the Invention

This invention relates to an inking unit for rotary printing presses with an ink fountain and an ink metering system on an ink fountain roller and, more specifically, to such an inking unit which employs a transfer roller, which is located between the ink fountain roller and a first distributor roller. The first distributor roller operates in conJunction with other ink rollers, which are located behind the first distributor roller and which transfer the required amount of ink to the printing plate of a plate cylinder.

2. Description of the Prior Art

In inking units of the prior art, an ink fountain roller is operated in conjunction with a vibrator roller, which executes a reciprocating, back-and-forth movement between the ink fountain roller and a first distributor roller. During contact of the vibrator roller with the ink fountain roller, an ink strip of a specified width is applied to the surface of the vibrator roller. When the vibrator roller is pivoted to the first distributor roller, the ink strip is transferred to the first distributor roller. The first distributor roller rotates at the speed of the press, while the ink fountain roller is driven at a lower speed.

A disadvantage of this type of prior art inking unit is that the vibrator roller must have its own control in order to insure that the vibrator roller is properly brought into alternating contact with the adjacent ink fountain and first distributor rollers. The back-and-forth movement results in discontinuous operation and wear of the vibrator roller. An accompanying noise is produced which has a disruptive effect on the operation of the machine. Further, it has been found that a significant amount of labor and equipment is also required to install and control the vibrator roller.

OBJECTS OF THE INVENTION

It is an object of the invention to provide an inking unit including features which simplify the transfer of the ink from an ink fountain roller to a first distributor roller.

It is another object to provide such an inking unit which eliminates the disadvantages of a vibrator roller.

It is a further object to provide such an inking unit which is less expensive and more reliable to operate.

SUMMARY OF THE INVENTION

These objects are achieved by the invention, in which the preferred transfer roller in the work position is generally disposed for engaging contact with the ink fountain roller and the first distributor roller. The transfer roller has a generally cylindrical surface formed of elastic material, the circumference of which alternately includes raised areas and recessed areas. The raised areas of the cylindrical surface are alternately in contact with the cylindrical surfaces of the ink fountain roller and of the first distributor roller, such that contact with one roller ends when the other roller comes in contact with a raised area. An advantage of this embodiment is its simple construction, without the requirement for additional control means, and continuous operation producing low noise and low wear.

A preferred configuration of the invention is characterized by the fact that the transfer roller is a light, low-mass tubular body. The raised areas consist of a rubber-like material, which is attached to the tubular body by adhesive or a vulcanizing process. As a result of the low mass, a transfer roller designed in this manner can respond very quickly to differences in speed existing between the ink fountain roller and the first distributor roller.

As a result, the various objects of the invention are provided in a preferred embodiment including an inking unit for a rotary printing press having ink rollers for providing ink to a printing plate of a plate cylinder. The inking unit includes an ink fountain and an ink fountain roller for receiving a supply of the ink thereon from the ink fountain. A first distributor roller transfers ink thereon to the ink rollers. A transfer roller is disposed between the ink fountain roller and the first distributor roller for transferring at least some of the ink on the ink fountain roller to the first distributor roller. The transfer roller is generally cylindrical and includes a surface which has a circumference which alternately includes raised areas and recessed areas. The transfer roller is in contact with the ink fountain roller at at least one of the raised areas to receive some of the ink therefrom when at least one of the recessed areas is adjacent the first distributor roller to prevent contact therebetween. Additionally, the transfer roller is in contact with the first distributor roller at at least one of the raised areas to supply some of the ink thereto when at least one of the recessed areas is adjacent the ink fountain roller to prevent contact therebetween.

DESCRIPTION OF THE PREFERRED EMBODIMENTS

Figure 1:
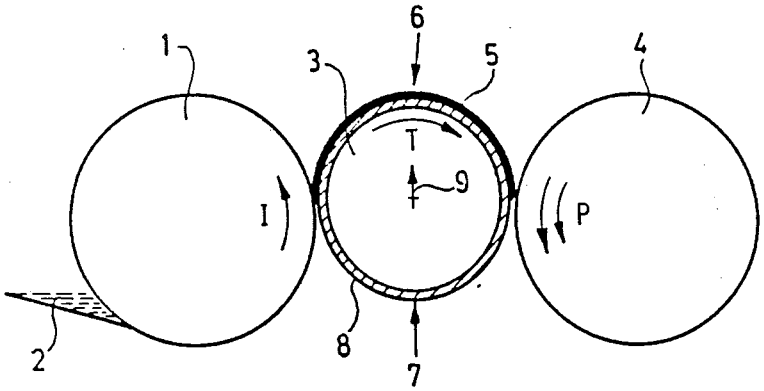
FIG. 1 includes a simplified, schematic view of a preferred transfer roller including various features of the invention.
Figure 2:
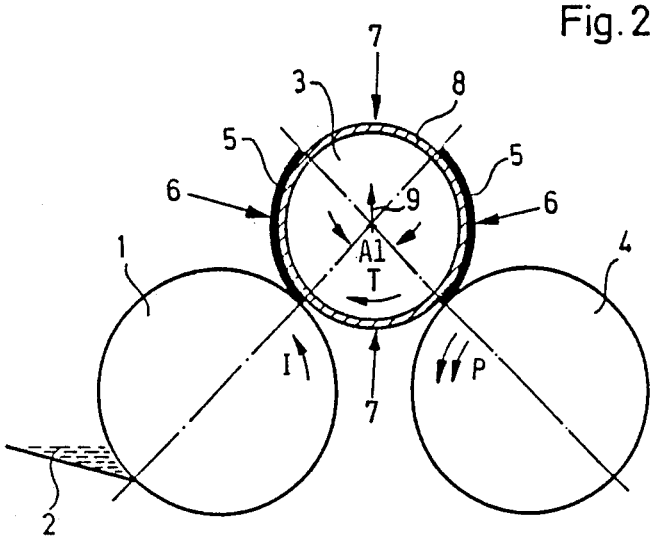
FIG. 2 includes a simplified, schematic view of an alternative embodiment of the invention.
Figure 3:
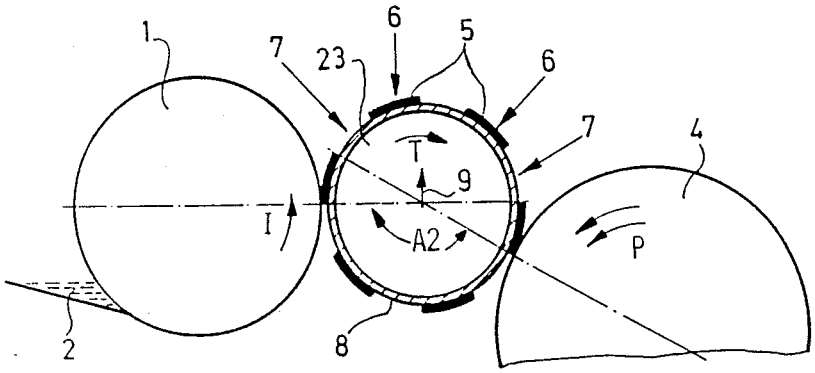
FIG. 3 includes a simplified, schematic view of still another embodiment of the invention.

As seen in FIGS. 1, 2 and 3, an ink fountain 2 is part of an inking unit, the purpose of which is well known in the printing art, to supply ink to a series of ink rollers which, in turn, apply ink to the printing plate of a plate cylinder (not shown). An ink fountain roller 1 is used in conjunction with the ink fountain 2 with an ink metering system (not shown). The ink metering system produces a thin film of ink on the ink fountain roller 1 and, depending on the varying consumption over the length of the ink fountain roller, can have a thickness which varies from zone to zone. The ink fountain roller 1 rotates at a circumferential speed which is less than the speed of the press but can be selectively varied to change the total amount of ink being transferred or supplied.

As seen in FIG. 1, a preferred transfer roller 3 is axially disposed parallel to the ink fountain roller 1 for rolling contact therewith. The transfer roller 3 is also disposed for rolling contact with a first distributor roller 4 which also rotates about an axis which is parallel to both the ink fountain roller 1 and the transfer rollers. The first distributor roller 4 transfers the ink to the next ink roller of a possible series of ink rollers of the inking unit as the required amount of ink is transported to the printing plate of a plate cylinder (not shown). The first distributor roller 4 can be driven at the circumferential speed of the plate cylinder.

In the working position, the transfer roller 3 is disposed for engaging contact with the ink fountain roller 1 and with the first distributor roller 4. The transfer roller 3 includes a cylindrical surface 5 formed of elastic material. On the circumference of the cylindrical surface 5, the transfer roller 3 includes alternating raised areas 6 and recessed areas 7, which extend over the length of the cylindrical surface 5. In FIG. 1, the cylindrical surface 5 of the preferred transfer roller 3 is divided so that both the raised area 6 and recessed area 7 respectively cover about 180 degrees of the surface. The ink fountain roller 1 and the first distributor roller 4 in this embodiment are also offset approximately 180 degrees with respect to the transfer roller 3. As a result, when the raised area 6 is in engaging contact with the ink fountain roller 1, the recessed area 7 is adjacent the first distributor roller 4 to prevent any contact therebetween, the contact between the ink fountain roller 1 and the raised area 6 causes the transfer roller 3 to be driven by friction at the same circumferential speed I of the ink fountain roller 1. When the raised area 6 comes into engaging contact with the first distributor roller 4 after the end of the raised area 6 leaves the jacket surface of the ink fountain roller 1, the transfer roller 3 will be driven by friction at the circumferential speed P of the distributor roller 4. The transfer roller 3 consists of a light, low-mass tubular body 8, so that the resulting speed changes or modifications can be achieved at a minimum slip rate. Accordingly, the circumferential speed T of the transfer roller will vary throughout rotation to be equal to the speed I of the ink fountain roller 1 during contact therewith and to be equal to the speed P of the first distributor roller 4 during contact therewith.

The raised area 6 of the cylindrical surface 5 may consist of a rubber-like material, which is attached to the tubular body 8 by adhesive or a vulcanizing process. The material at the raised area 6 may be, for example, a plastic coating material with a high resistance to abrasion and including characteristics similar to those of rubber. Inking rollers, roller drives, and rollers having elastic surfaces are described in U.S. Pat. Nos. 4,440,081 and 3,538,849, both of these issued U.S. Patents being hereby expressly incorporated by reference as if they were set forth in their entirety herein.

Because of the ink splitting, the embodiment illustrated in FIG. 1 operates so that the raised area 6 of the cylindrical surface 5 rolls along the cylindrical surface of the ink fountain roller 1 and takes on by separation approximately one-half of the amount of ink being fed thereto. As the transfer roller 3 rolls over the jacket surface of the first distributor roller 4, only approximately one-half of the ink is applied to the first distributor roller 4 because of ink splitting, again by separation. During transfer of the ink to the distributor roller 4, the recessed area 7 is adjacent the ink fountain roller 1 to prevent any rolling contact between the transfer roller 3 and the ink fountain roller 1, so that the transfer roller can rotate without slippage against the first distributor roller 4 which is rotating at a higher speed.

FIG. 2 includes an alternative transfer roller 13 with two raised areas 6 and two recessed areas 7 on its cylindrical surface 5, which areas are offset from one another by approximately 90 degrees. The ink fountain roller 1 and the distributor roller 4 are similar to those shown in FIG. 1 but are offset at angle A1 from the transfer roller 3 by about 90 degrees. The same type of alternating contact with the ink fountain roller 1 and first distributor roller 4 would occur for the transfer roller 13 but would be twice as often as with the transfer roller 3.

In the embodiment shown in FIG. 3, the transfer roller 23 has a cylindrical surface 5 including the raised areas 6 which alternate with the recessed areas 7 at an angle of about 30 degrees. As a result, the ink fountain roller 1 and the distributor roller 4 are offset at angle A2 from the transfer roller 23 by about 150 degrees. In the embodiment of FIG. 3, the transfer roller 23 with a total of six raised areas 6 transfers ink strips in close succession to the first distributor roller 4 but would experience even more speed changes than the embodiment of FIG. 2.

It should be noted that the total amount of the ink transferred in all the embodiments illustrated in FIG. 1 to FIG. 3 is approximately the same. By changing the speed difference between the ink fountain roller 1 and the first distributor roller 4, the amount of ink to be transferred can be changed, so that with an inking unit configured in this manner, the ink regulation can be achieved in a similar manner as with a vibrator-type inking unit of the prior art. It should also be noted that in all the embodiments, the transfer rollers 3, 13, 23 can be moved away in the direction of the arrow 9 from the rollers 1 and 4. Movement in the direction 9 may be employed to change an older transfer roller to a new transfer roller or to make minor adjustments to the position of the transfer roller to insure proper contact with the ink fountain roller and the first distributor roller.

Of course, various other configurations of the cylindrical surface and of the rollers can be used while still being within the scope of the invention. For example, while the preferred raised areas are approximately 180 degrees, 90 degrees and 30 degrees respectively, it might be desirable to form each raised area to cover slightly fewer degrees than the recessed areas therebetween. The slightly smaller raised areas would insure that the ink fountain roller and the first distributor roller could be relatively disposed to further insure that no contact was made with either roller until contact between the raised area and the other roller is discontinued.

In summing up, one aspect of the invention resides broadly in an ink mechanism for rotary printing presses with an ink fountain 2 and an ink dosing system on an ink fountain roller 1, with a transfer roller 3, which is located between the ink fountain roller 1 and a first distributor roller 4, and with ink rollers located behind the first distributor roller 4, and which transport the required amount of ink to the printing plate of a plate cylinder, characterized by the fact that the transfer roller 3 in the work position is in contact with the ink fountain roller 1 and the first distributor roller 4, that the transfer roller 3 exhibits a cylindrical surface 5 made of elastic material, which has alternating raised 6 and recessed areas 7 on its circumference, and that the raised areas 6 of the jacket surface 5 alternately contact the cylindrical surfaces of the ink fountain roller 1 and the first distributor roller 4, so that contact with one roller 1 or 4 ends when the other roller comes in contact with the raised area 6.

Another aspect of the invention resides broadly in an ink mechanism characterized by the fact that the transfer roller 3 is a light, low-mass tubular body 8, and that the raised areas 6 consist of a rubber-like material, which is attached to the tubular body 8 by adhesive or vulcanization.

A number of patents disclose inking units for printing presses. A few examples of these patents are U.S. Pat. No 4,660,470; German Patent Nos. 34 01 886 and 29 42 734; French Patent No. 1,401,718; and European Patent No. 0 036 103. These patents are hereby expressly incorporated by reference as if they were set forth in their entirety herein.

The invention as described hereinabove in the contest of a preferred embodiment is not to be taken as limited to all of the provided details thereof, since modifications and variations thereof may be made without departing from the spirit and scope of the invention.

What is claimed is:

1. An inking unit for a rotary printing press having ink roller means for providing ink to a printing plate of a plate cylinder comprising:

an ink fountain;

an ink fountain roller rotatably mounted and rotatably driven for receiving a supply of the ink thereon from said ink fountain;

a first distributor roller rotatably mounted and rotatably driven for transferring the ink thereon to the ink roller means;

at least one transfer roller which is rotatably mounted and rotatable about a central axis and disposed between said ink fountain roller and said first distributor roller for transferring at least some of the ink from said ink fountain roller to said first distributor roller;

said at least one said transfer roller being generally cylindrical and including a surface which has a circumference which includes at least one raised area and at least one recessed area;

said at least one said transfer roller being mounted for at least one said raised area to be in contact with said ink fountain roller to receive the some of said ink therefrom when said at least one of said recesssed areas is adjacent said first distributor roller;

said one said transfer roller being mounted for at least one said raised area to be in contact with said first distributor roller to supply said some of the ink thereto when said at least one of said recessed areas is adjacent said ink fountain roller;

said ink fountain roller supplying rotational power to said at least one said transfer roller when said at least one said raised area of said transfer roller is in contact with said ink fountain roller; and said first distributor roller supplying rotational power to said at least one said transfer roller when said at least one said raised area of said transfer roller is in contact with said first distributor roller.

2. The inking unit according to claim 1, wherein at least said raised areas of said transfer roller include an elastic material.

3. The inking unit according to claim 1, wherein said first distributor roller rotates at a first circumferential speed generally corresponding to a printing speed of said printing press, said ink fountain roller rotates at a second circumferential speed, and said transfer roller alternately rotates at a third circumferential speed which corresponds to said first circumferential speed when contacting said first distributor roller and at a fourth circumferential speed which corresponds to said second circumferential speed when contacting said ink fountain roller.

4. The inking unit according to claim 3, wherein said first circumferential speed is faster than said second circumferential speed, and said third circumferential speed is faster than said fourth circumferential speed.

5. The inking unit according to claim 1, wherein said raised areas and said recessed areas cover circumferential sections of said transfer roller which are generally equal.

6. The inking unit according to claim 5, wherein said circumferential sections extend about 180 degrees and said ink fountain roller and said first distributor roller are offset about 180 degrees with respect to said transfer roller.

7. The inking unit according to claim 5, wherein said circumferential sections extend about 90 degrees and said ink fountain roller and said first distributor roller are offset about 90 degrees with respect to said transfer roller.

8. The inking unit according to claim 5, wherein said circumferential sections extend about 30 degrees and said ink fountain roller and said first distributor roller are offset about 150 degrees with respect to said transfer roller.

9. The inking unit according to claim 1, wherein said transfer roller includes a hollow, tubular body.

10. The inking unit according to claim 9, wherein said tubular body includes a rubber-like material thereon.

11. A transfer device for an inking unit of a rotary printing press, wherein the inking unit includes an ink fountain and an ink fountain roller for receiving a supply of ink thereon from the ink fountain, wherein said transfer device transfers at least some of the ink from the ink fountain roller to a first distributor roller and the first distributor roller supplies some of the ink to ink roller means for providing the ink to a printing plate of a plate cylinder, said transfer device comprising:

at least one transfer roller for being rotatably mounted and rotatable about a central axis and disposed between the ink fountain roller and the first distributor roller for transferring at least some of the ink from the ink fountain roller to the first distributor roller;

said at least one said transfer roller being generally cylindrical and including a surface which has a circumference which includes at least one raised area and at least one recessed area;

said at least one said transfer roller for being mounted for at least one said raised area to be in contact with the ink fountain roller to receive said some of the ink therefrom when said at least one of said recessed areas is adjacent the first distributor roller;

said at least one said transfer roller for being mounted for at least one said raised area to be in contact with the first distributor roller to supply said some of the ink thereto when at least one of said recessed areas is adjacent the ink fountain roller;

the ink fountain roller supplying rotational power to said at least one said transfer roller when said at least one said raised area of said transfer roller is in contact with the ink fountain roller; and the first distributor roller supplying rotational power to said at least one said transfer roller when said at least one said raised area of said transfer roller is in contact with the first distributor roller.

12. The transfer device according to claim 11, wherein said raised areas and said recessed areas cover circumferential sections of said transfer roller which are generally equal.

13. The transfer device according to claim 11, wherein said first distributor roller for said transfer device is rotatable at a first circumferential speed generally corresponding to a printing speed of said printing press, said ink fountain roller for said transfer device is rotatable at a second circumferential speed, and said transfer roller being alternately rotatable at a third circumferential speed which corresponds to said first circumferential speed when contacting said first distributor roller and at a fourth circumferential speed which corresponds to said second circumferential speed when contacting said ink fountain roller.

14. The transfer device according to claim 13, wherein said first circumferential speed is faster than said second circumferential speed, and said third circumferential speed is faster than said fourth circumferential speed.

15. The transfer device according to claim 11, wherein said transfer roller includes a hollow, tubular body.

16. The transfer device according to claim 15, wherein said tubular body includes a rubber-like material thereon.

17. The transfer device according to claim 16, wherein said rubber-like material is disposed at least in said raised areas.

* * * * *

Disclaimer and Dedication 4,896,601.—*Willi Jeschke,* Bad Herrenalb, Fed. Rep. of Germany. INKING UNIT FOR ROTARY PRINTING PRESSES. Patent dated Jan. 30, 1990. Disclaimer and Dedication filed July 3, 1990, by the assignee, Heidelberger Druckmaschinen Aktiengesellschaft.

Hereby disclaims and dedicates to the Public claims 1-4 and 11-14 of said patent.

[*Official Gazette September 18, 1990* ]